US006343389B1

(12) United States Patent
Jones

(10) Patent No.: US 6,343,389 B1
(45) Date of Patent: Feb. 5, 2002

(54) WATER OUTLETS FOR AN ABLUTIONARY DEVICE OR APPLIANCE

(75) Inventor: David Timothy Lloyd Jones, Tan-y-Bryn Farm, Llaingoch, The Mountain Holyhead, Anglesey LL65 1YS (GB)

(73) Assignee: David Timothy Lloyd Jones (GB)

( * ) Notice: Subject to any disclaimer, the term of this patent is extended or adjusted under 35 U.S.C. 154(b) by 0 days.

(21) Appl. No.: 09/550,533

(22) Filed: Apr. 17, 2000

(30) Foreign Application Priority Data

Oct. 18, 1997 (GB) ..... 9721982

(51) Int. Cl.[7] ..... A47K 3/28

(52) U.S. Cl. ..... 4/605; 4/615; 239/109; 239/533.1; 239/541; 239/586

(58) Field of Search ..... 4/597, 605, 615; 239/67, 68, 106–109, 452, 453, 459, 533.1, 533.15, 541, 570, 572, 583, 586

(56) References Cited

U.S. PATENT DOCUMENTS 2,583,233 A * 1/1952 Russell ..... 239/109
2,680,649 A * 6/1954 Hansen ..... 239/109
3,053,461 A * 9/1962 Inglis ..... 239/533.1 X
4,854,499 A * 8/1989 Neuman ..... 4/605 X

* cited by examiner

*Primary Examiner*—Robert M. Fetsuga
(74) *Attorney, Agent, or Firm*—Welsh & Katz, Ltd.; Thomas W. Tolpin

(57) ABSTRACT

A water outlet (10) for an ablutionary device has a member which is moved to open and close a vent into the body of the outlet (10). In one embodiment, the outlet (10) is a shower head (10A) having a discharge opening (26) which serves as the vent. A perforate shower plate (12A) located in the opening closes the vent while the shower (10A) is in operation so that water issues from the opening (past the plate (12A)) as a spray. When the water supply is turned off the shower plate (12A) is moved out of the opening (26) to open an annular vent (14A) into the interior of the body of the shower head (10A) to aid drying of the interior. When the water supply is turned on the plate (12A) is moved back into the opening (26) to close the vent (14A).

13 Claims, 9 Drawing Sheets

WATER OUTLETS FOR AN ABLUTIONARY DEVICE OR APPLIANCE

This invention concerns water outlets such as shower heads and water spouts for ablutionary devices or appliances.

It is known to adapt outlets to help water to drain from the outlets when a flow of water is no longer being supplied to the outlets to minimise the risk of the outlets being damaged by frost, and it is commonplace for some water to drain out of outlets when the supply flow thereto ceases.

However conventional outlets usually remain internally moist when not in use, and it is known for bacteria to multiply therein causing problems. For example, some such bacteria are pathogens, e.g. legionella, and others can form muscus-like films and multiply to an extent sufficient to block or restraint the fine spray holes in outlets such as shower heads.

In order to reduce such problems, in accordance with the present invention there is provided an outlet of the aforementioned kind is characterised in that it is provided with at least one vent to admit air into a body of the outlet and a member movable between an in-use position in which it at least partially closes the vent and a not in-use position in which the vent is open so that air can circulate within the body to remove moisture.

For those outlets which are in the form of shower heads having a perforate shower plate situated in a discharge opening in the body, the shower plate may be movable to serve as said member and the discharge opening may serve as said vent, the shower plate being movable between the in-use position in which it occupies the discharge opening to close the vent (except for the perforations in the plate itself) and the out of use position in which it is clear of the discharge opening so that air can flow freely into the body and around the plate. The plate is preferably accessible or exposed for disinfecting or cleaning on both sides in the not in-use position.

For these outlets which are in the form of spouts, e.g. on tap fittings for sinks, baths and bidets, the vent is preferably provided in the body remote from the water discharge opening and the member preferably moves so that in the not in-use position air can pass freely through the body from the vent to the discharge opening or vice versa.

The vent preferably provides access into the outlet for injection of disinfectant or cleaning solutions.

The member is preferably movable by an actuator. The actuator is preferably responsive to water pressure to move the member from the not in-use position to the in-use position, and is also preferably biased to move the member in the reverse direction. However, the actuator may be manually, electrically or thermally actuated.

The actuator or a further actuator preferably controls a valve which controls a purging flow passage in the body. A drain conduit or duct may be attached to or disposed adjacent to the body to receive purging water from said flow passage.

The actuator or further actuator may incorporate means to provide hysteresis in moving the valve from a closed condition to allow a purging flow of water through the outlet and via the flow passage to drain conduit or duct. The actuator may incorporate means to provide hysteresis also in moving the member from the not in-use to the in-use position, especially in shower head versions of the outlet, and means to inhibit discharge of water as a fine spray until the outlet has been purged.

The actuator may also move a valve to close a passage between an inlet to the body and the, or a, discharge opening when the outlet is moved to the not in-use condition.

The invention will be described further, by way of example with reference to the accompanying diagrammatic drawings, wherein.

Figure 1:
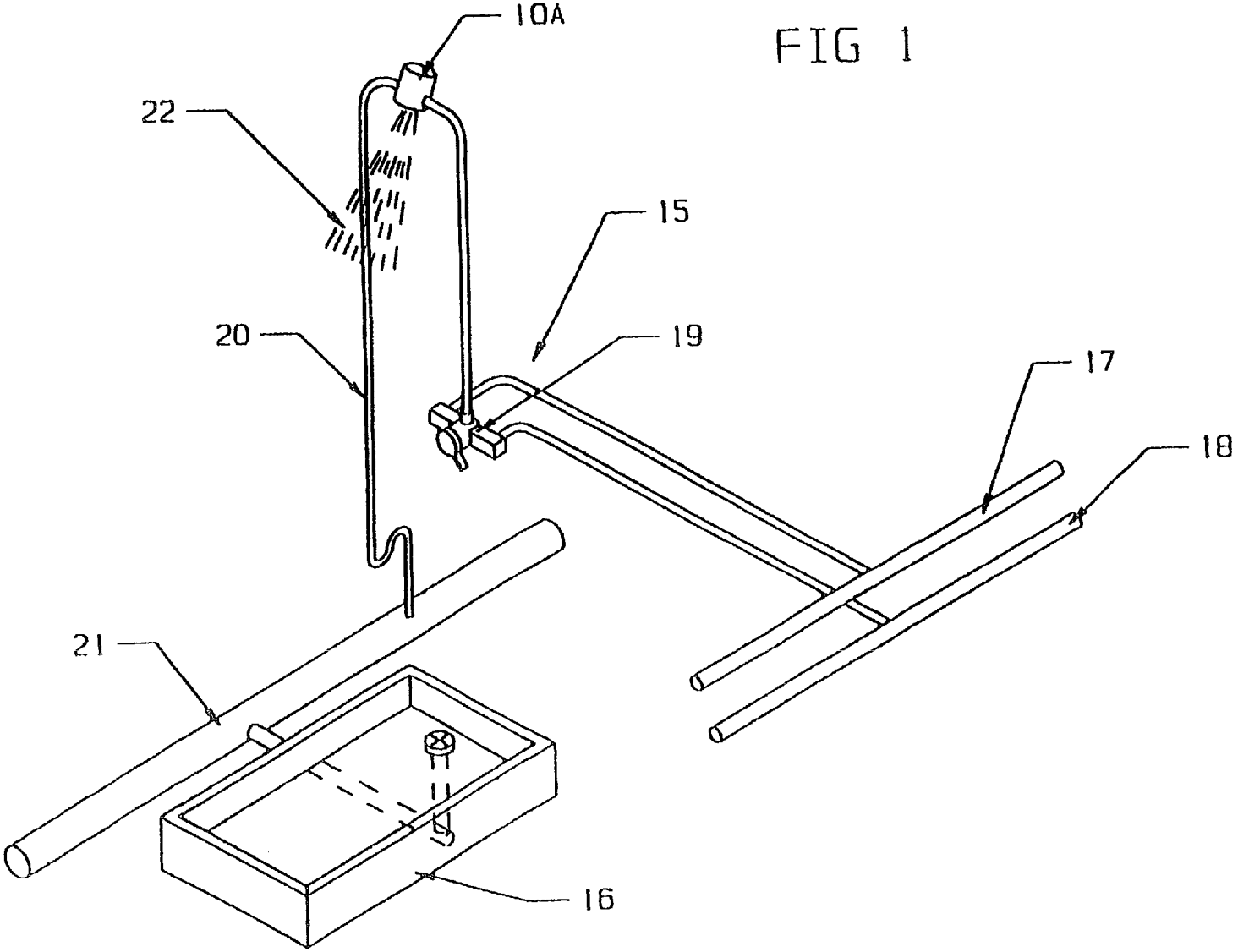
FIG. 1 shows the schematic arrangement of an ablutionary device or appliance in the form of a shower with hot and cold water supply ductwork feeding an outlet in the form of a shower head of the invention via a manually settable supply valve.

In all embodiments the outlet 10 comprises a hollow body 11, a member 12 (various forms of which are referenced hereinafter by suffix letters A,B,C, et seq) which is movable by an actuator 13 to open and close a vent 14 for admitting air into the body.

Figure 2:
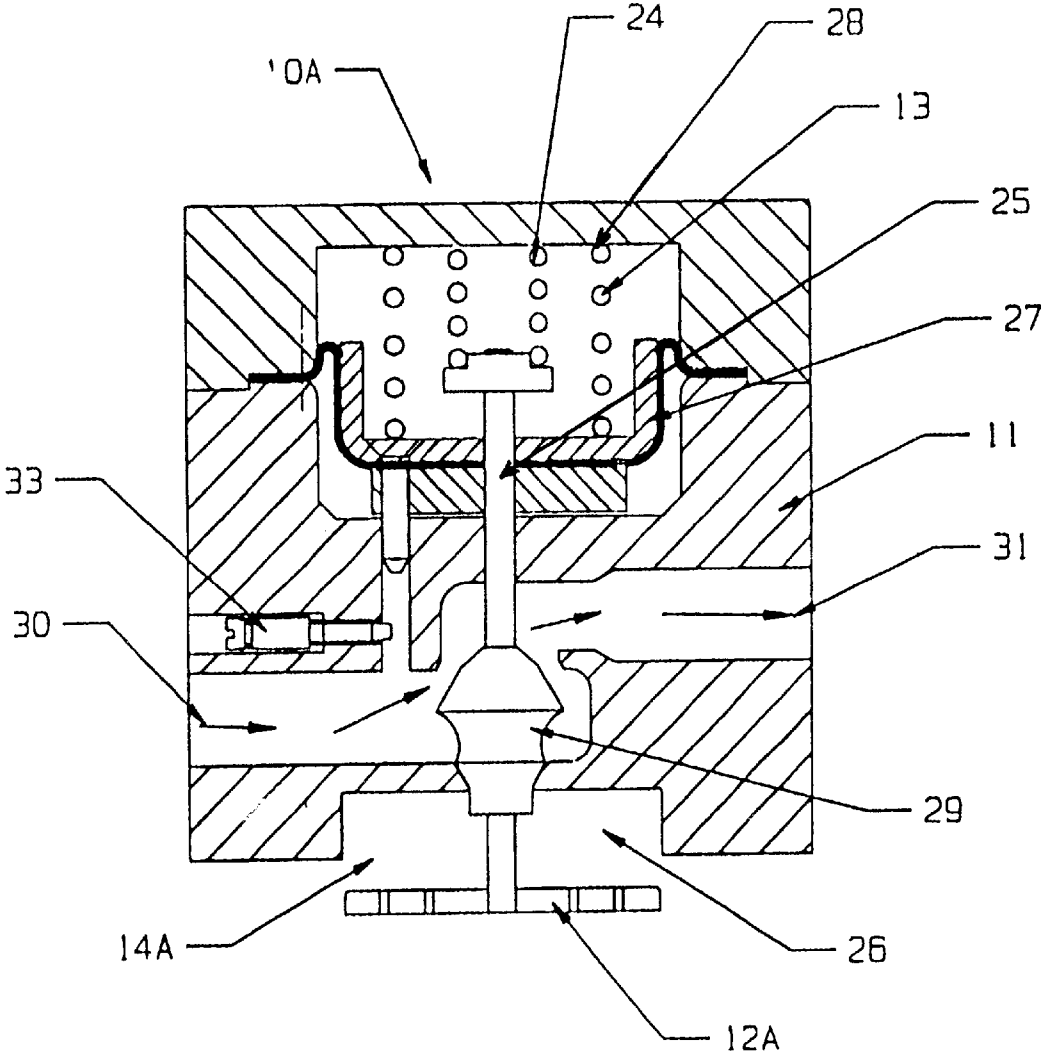
FIGS. 2 and 3 are cross-sectional diagrams showing the shower head in "not in use" and "in use" conditions respectively.
Figure 3:
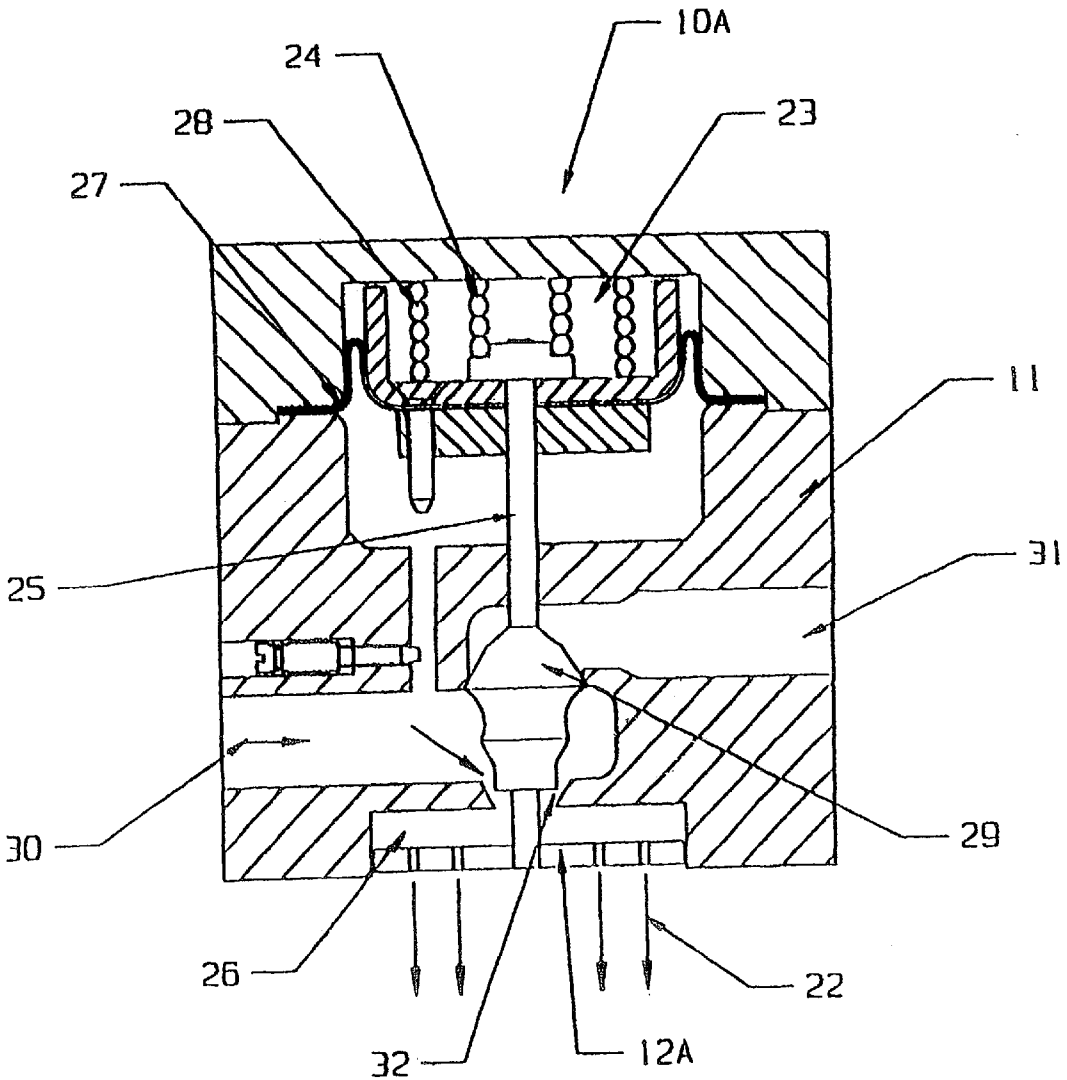

In the first embodiment shown in FIGS. 1 to 3 the outlet 10 is in the form of a shower head 10A for use in a shower installation 15 which includes a usual tray 16, supply hot pipe 17, supply cold pipe 18, a thermostatic or manually settable supply valve 19, and optionally a drain duct 20 leading from the head 10A to a usual waste water drain pipe 21.

In the head 10A the member 12 is in the form of a perforate shower plate 12A and the body has a discharge opening 26 which the plate 12A substantially closes (FIG. 3) when the shower is in operation so that water only issues through the perforations as a spray 22.

When the supply of water is turned off, the actuator 13, comprising a bias spring 24 which acts on a thrust rod 25, moves the plate 12A out of the opening to the not in-use position (FIG. 2) so that air can flow easily through the annular vent 14A between the periphery of the plate and the body 11 to dry out the back of the plate and the interior of the body.

The actuator 13 further includes a diaphragm 27 movable by water pressure against a bias provided by a spring 28 to raise the rod 25 against the spring 24 to ram the plate 12A back into the opening 26 to close the vent 14A.

In this embodiment the actuator also actuates a valve 29 carried by the rod 25 between a purging condition (FIG. 2) in which water entering an inlet 30 to the body can exit via a passage 31 to the duct 20, and a showering condition in which the flow to the passage 31 is shut off and a further passage 32 to the opening 26 is open. The period in which the purging condition exists can be adjusted by means of a throttle screw 33 to vary the flow rate of the water flowing to one side of the diaphragm 27 whereby to provide a delay or actuation hysteresis in the response of the actuator to the onset of water being supplied to the outlet.

Figure 4:
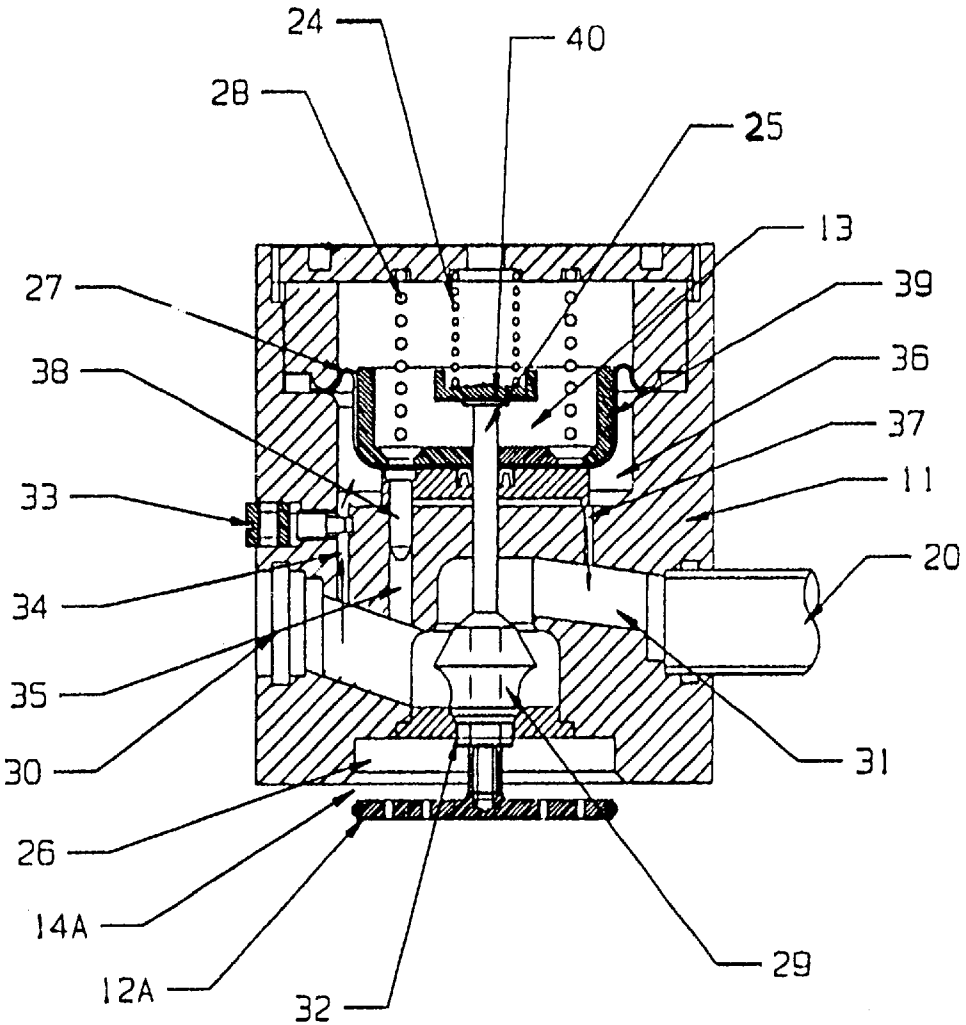
FIG. 4 is a more detailed cross-sectional diagram of a modified form of the shower head shown in FIG. 2.

The mechanism for providing hysteresis is more clearly shown in FIG. 4, and comprises in detail a metering passage 34 variably restrictable by the screw 33, a larger bore 35 in parallel between the inlet 30 and the diaphragm pressure chamber 36, a bleed passage 37 running from the chamber 36 to the passage 31, and a short piston slidable in the bore 35 and movable by the diaphragm 27 which is partially supported by a cup assembly 39 on which the piston 38 is mounted and which is abutted by the spring 28. When water starts to flow into the body 11 some flows through the passage 34 into the chamber and a proportion will flow out through the bleed passage 37 so that there is an initial period in which the chamber 36 is being pressurised and the cup assembly 39 is being lifted relatively slowly. During the initial period there will be a purging flow of water through the body to the duct 20. When the assembly 39 has risen far enough to lift the piston 38 from the bore 35, the bore will admit a sudden inrush of water into the chamber to slam the cup assembly upwards to strike a collar 40 on the rod 25 and to move the rod, plate and valve 29 upwards suddenly to terminate the purging flow and initiate the spray discharge.

There are a multiplicity of other ways of opening and closing the vent 14 some of which are schematically outlined in FIGS. 5 to 9.

Figure 5:
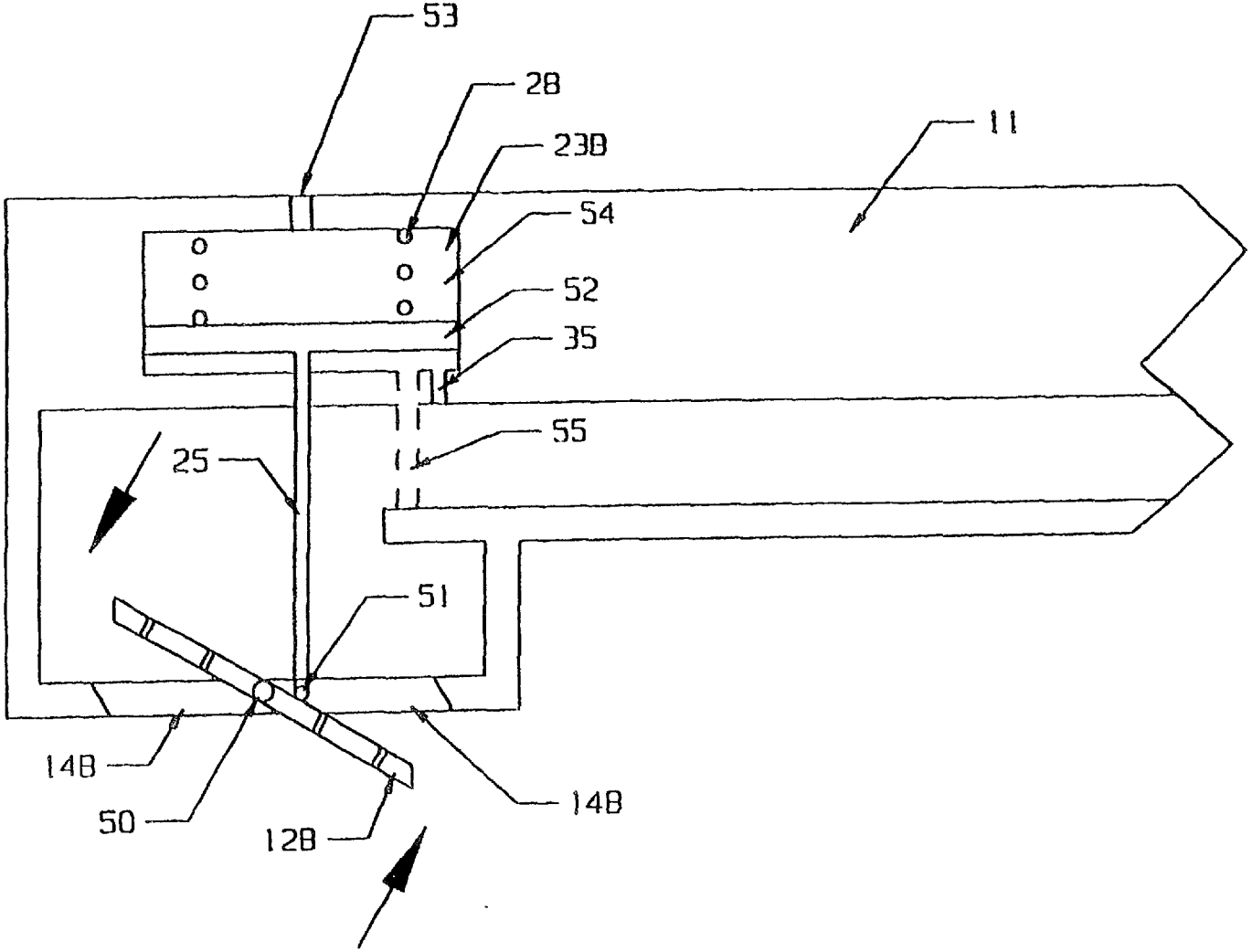
FIGS. 5 to 9 are simplified sectional diagrams showing six further embodiments of outlet of the invention.

In the embodiment shown in FIG. 5 the shower plate 12B is mounted on a pivot rod 50 and the actuator 23B comprising a piston 52 in a chamber 54, and is directly connected to the rod 25 which is connected by a further pivot 51 (offset from the axis of the rod 50) on the plate 12B to swing the plate about said axis so as to open and close a pair of vents 14B. The piston 52 may also carry a valve member 55 (shown in broken lines) which closes off the inlet passage in the not in-use condition, and which when initially partially lifted by the initial supply of water, restricts the flow to the opening 26 so that it dribbles or flows non-forcibly through the vents and, as the plate rotates to close the vents, through the perforations in the plate so as not to produce fine droplets which can be inhaled. This non-spray producing initial flow can thus serve to purge the outlet, before spraying commences. A restrictive air flow passage 53 may lead to the chamber 54 to damp the motion of the piston 52.

Figure 6:
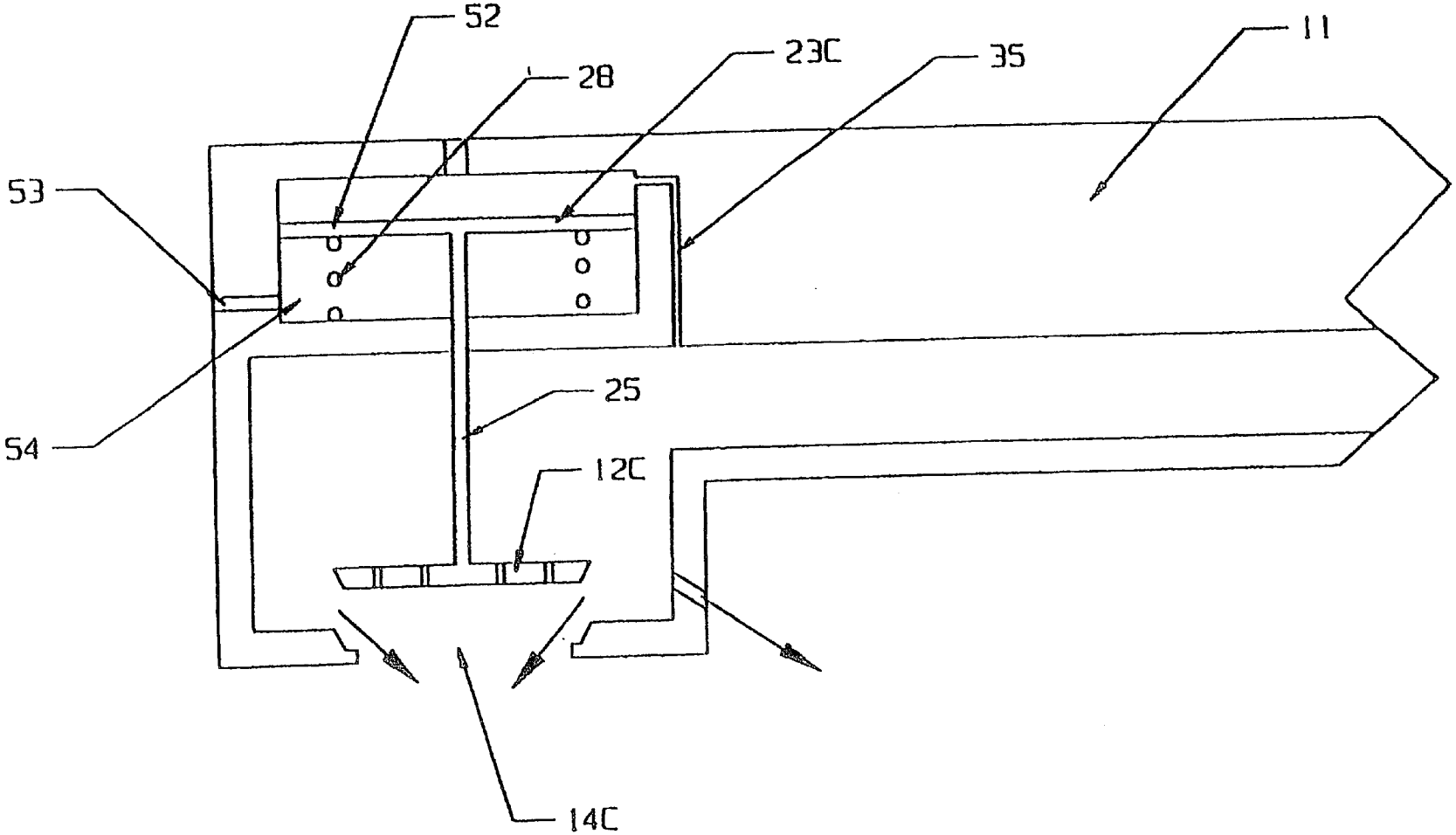

In the embodiment shown in FIG. 6, the operation of the actuator 23C is reversed so that the shower plate 12C is drawn into the body 11 instead of being extended from or rotated relative to the body 11.

Whilst it is convenient to use the shower plate as the member 12 it is not essential to do so, and other forms of member 12 may be used for shower heads, and should be used for other forms of outlet 10. For example, the vents 14D may be provided in the body 11 separate from the discharge opening 26D shown in broken lines in FIG. 7, and the member 12 and actuator 13 are combined to be in the form of a piston 70 having a skirt 71 with ports 72 therein which register with said vents 14D in the not in-use condition. The speed with which the piston 70 is moved forwards (arrow A) against the bias of a spring 73 depends upon water pressure and the sizes of further ports 74 in the piston crown, and, optionally, the resistance provided by an adjustable pneumatic damper 75 indicated in broken lines in FIG. 7. In this embodiment, the outlet instead of being occupied by a spray member 76 may be in the form of an opening 26D at the end of a spout or nozzle 77.

A trough 78 may be provided to collect purge water flowing whilst the piston is moving forwards to close the vents.

Figure 7:
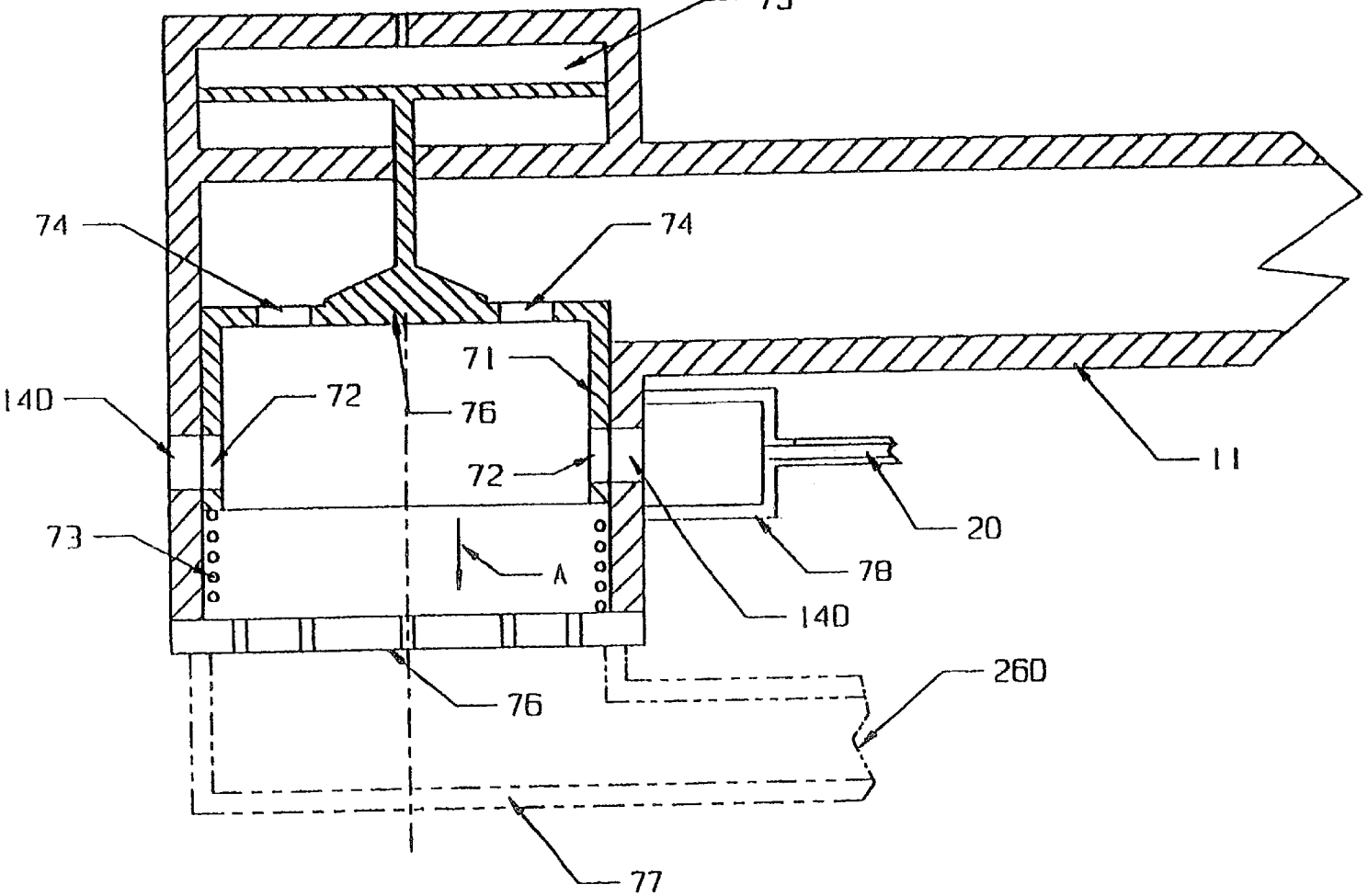
Figure 8:
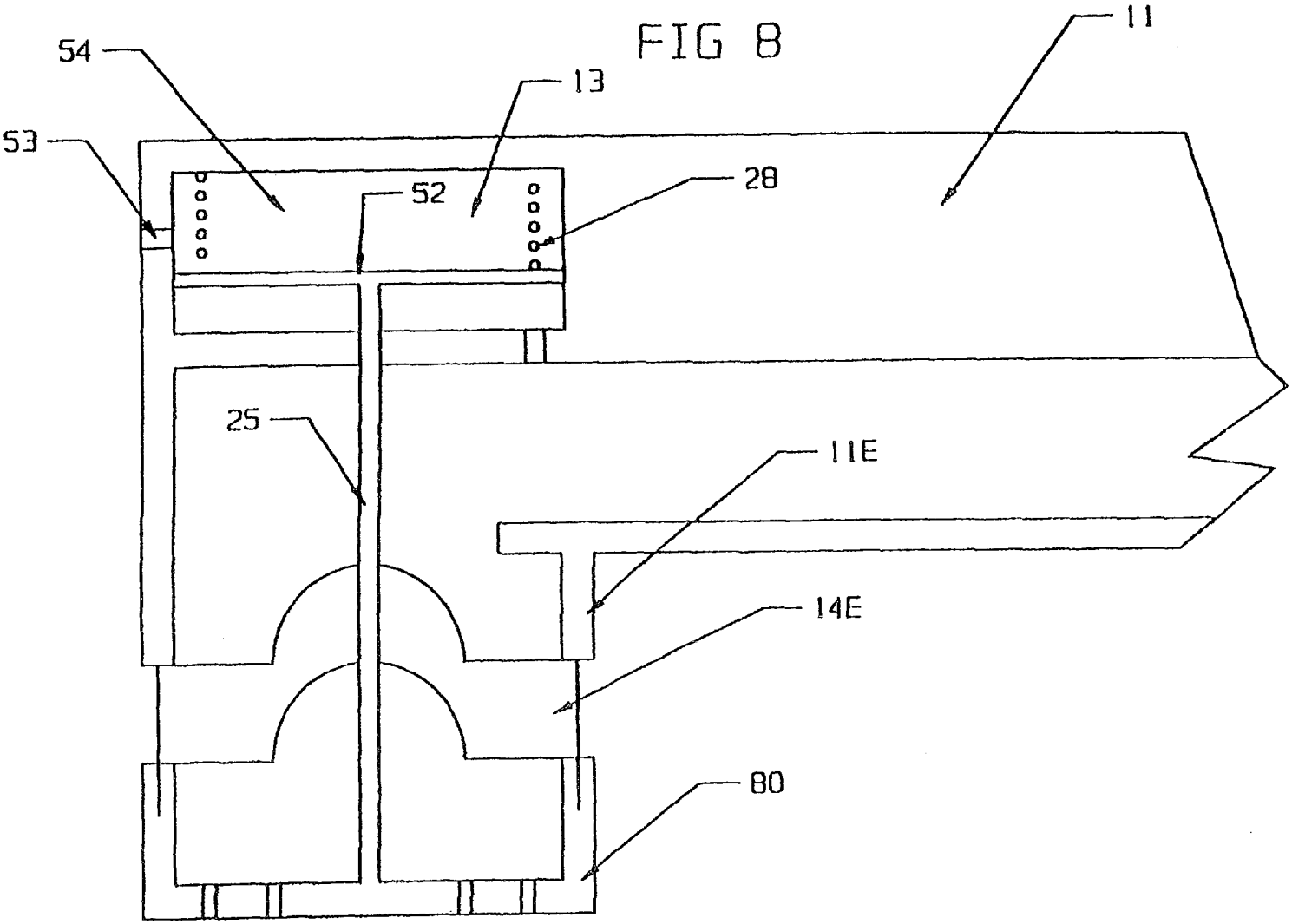

The embodiment shown in FIG. 8 is closer to that shown in FIG. 1 than that shown in FIG. 7, and primarily includes a piston form of the actuator 13 to move a shower plate and front body member 80 forwards to open an annular vent gap 14E between said member 80 and the body part 11E when the supply of water ceases. The vent gap 14E may be disposed over the purge drain trough 78.

Figure 9:
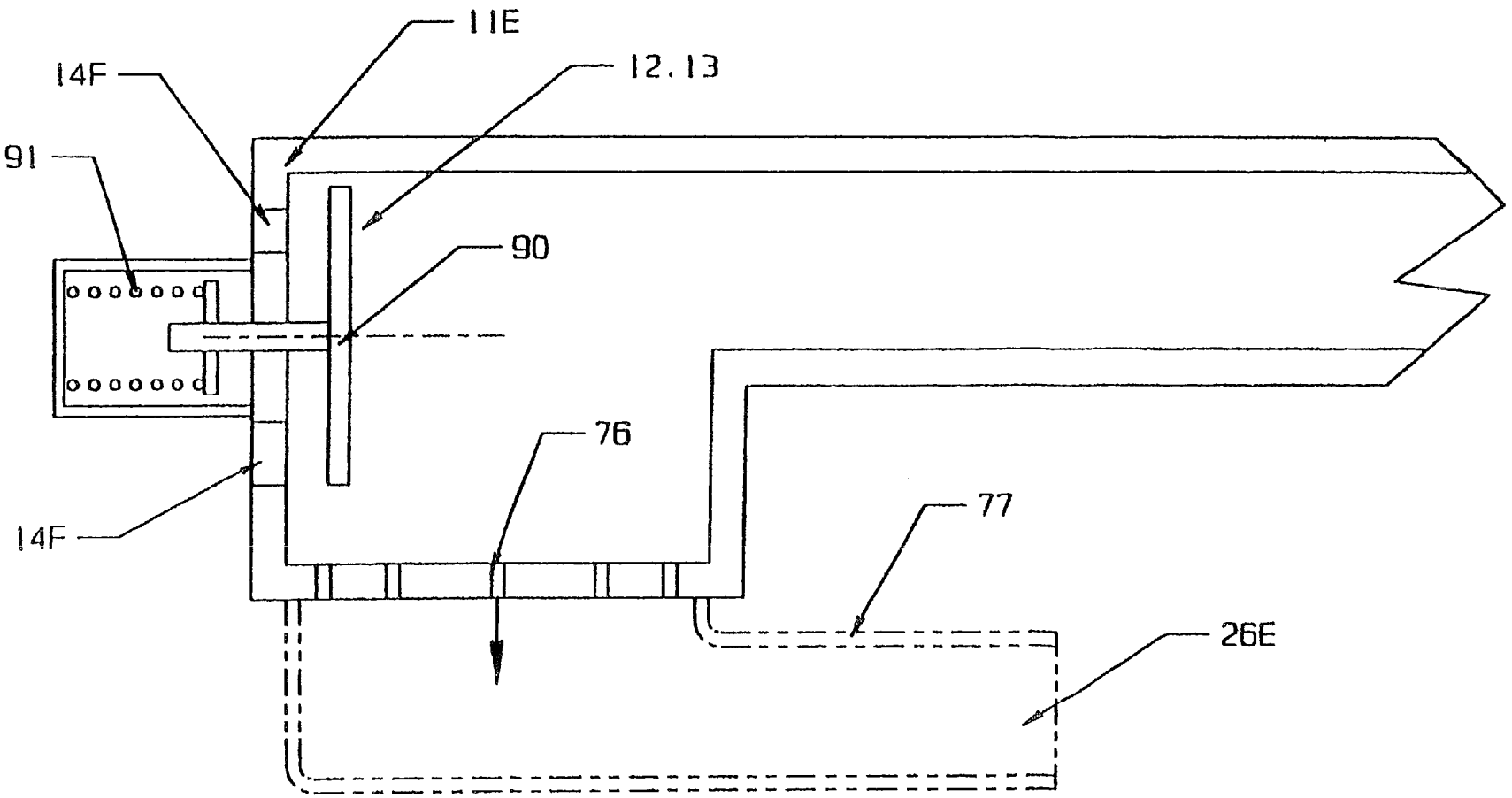

In the embodiment shown in FIG. 9, the member 12 and actuator 13 are again combined in the form of a piston 90 which is movable by water pressure against the bias of a spring 91 to move to cover vents 14F provided in the body 11E.

The body may have a spout 77 and outlet 26E (shown in broken lines in FIG. 9) attached thereto instead of being provided with, or incorporating an integral, spray plate 76.

The invention is not confined to details of the foregoing examples, and many variations are possible within the scope of the invention. For example the outlet of the invention may include any functional combination of features from one embodiment with features taken from another embodiment or embodiments or features known from other outlets.

Although it is preferred to use the pressure or absence of water under pressure to provide energy for operation of the outlet to and from its in-use condition from and to its vented not in-use condition, the outlet can be modified so that said energy can be provided manually via a manually movable lever, rod or cam; or electrically by means of a solenoid; or thermally via a thermally responsive, e.g. bimetallic, device which deflects when heated to move that member 12 which closes the vent 14. Such a thermally responsive actuator will also provide hysteresis to permit purging of the outlet as the actuator heats up.

The invention further includes and provides an outlet having any novel, or novel combination of, parts, functional features or arrangement of parts disclosed herein or in the accompanying drawings.

What is claimed is:

1. A water outlet which is in the form of a shower head comprising a body having a perforate shower plate situated in a water discharge opening in the body, the shower plate being movable by an actuator between an in-use position in which it at least partially closes the discharge opening so that in use water issues through the perforations in the plate and an out of use position in which it is clear of the discharge opening so that air can flow freely into the opening and around the plate, wherein the water outlet further comprises a valve movable by the actuator between a closed position in which it closes a passage between a water inlet to the body and the discharge opening when the shower plate is moved to the out of use position, and an open position in which it permits water to flow from the inlet into the discharge opening when the shower plate is moved to the in-use position.

2. A water outlet according to claim 1 wherein the shower plate occupies the discharge opening in the in-use position.

3. A water outlet according to claim 2 in which the shower plate is accessible or exposed for disinfecting or cleaning on both sides in the out of use position.

4. A water outlet according to claim 2 in which the actuator is responsive to water pressure to move the shower plate from the out of use position to the in-use position.

5. A water outlet according to claim 1 in which the shower plate is accessible or exposed for disinfecting or cleaning on both sides in the out of use position.

6. A water outlet according to claim 5 in which the actuator is responsive to water pressure to move the shower plate from the out of use position to the in-use position.

7. A water outlet according to claim 1 in which the actuator is responsive to water pressure to move the shower plate from the out of use position to the in-use position.

8. A water outlet according to claim 1 in which the actuator is biased to move the member from the in-use position to the out of use position.

9. A water outlet according to claim 1 in which the actuator is arrange to move a valve between an out of use position in which the valve opens a purging flow passage in the body and in-use position in which the valve close the purging flow passage in the body.

10. A water outlet according to claim 1 in which the a drain conduit or duct is attached to or disposed adjacent to the body to receive purging water from said flow passage.

11. A water outlet according to claim 1 in which the actuator incorporates means to provide hysteresis in moving the valve from a closed condition to allow a purging flow of water through the outled and via the flow passage to a drain conduit or duct.

12. A water outlet according to claim 1 in which the actuator incorporates means to provide hysteresis in moving the shower plate from the out of use position to the in-use position and means to inhibit discharge of water as a fine spray until the outlet has been purged.

13. An ablutionary device which comprises a water outlet according to claim 1.

* * * * *